US006368084B1

(12) United States Patent
Skillman

(10) Patent No.: US 6,368,084 B1
(45) Date of Patent: Apr. 9, 2002

(54) DOWNSTROKE SUCKER ROD WELL PUMP

(75) Inventor: Milton M. Skillman, Mt. Vernon, TX (US)

(73) Assignee: Skillman Pump Company, LLP, Austin, TX (US)

( * ) Notice: Subject to any disclaimer, the term of this patent is extended or adjusted under 35 U.S.C. 154(b) by 0 days.

(21) Appl. No.: 09/495,341

(22) Filed: Feb. 1, 2000

(51) Int. Cl.[7] ..... F04B 53/12; F04B 19/02; F04B 53/00

(52) U.S. Cl. ..... 417/554; 417/460; 417/555.2; 417/555.1

(58) Field of Search ..... 417/555.1, 555.2, 417/554, 460

(56) References Cited

U.S. PATENT DOCUMENTS

| | | | | | |
|---|---|---|---|---|---|
| 1,545,474 | A | * | 7/1925 | Adams | 166/105.4 |
| 1,545,475 | A | * | 7/1925 | Adams | 417/430 |
| 1,785,834 | A | * | 12/1930 | Kilgore | 417/554 |
| 3,220,354 | A | * | 11/1965 | Sutliff | 103/179 |
| 3,684,410 | A | * | 8/1972 | Fitzgerald et al. | 417/554 |
| 4,451,209 | A | * | 5/1984 | Phillips | 417/38 |
| 5,063,775 | A | * | 11/1991 | Walker, Sr. et al. | 73/155 |
| 5,141,416 | A | * | 8/1992 | Cognevich et al. | 417/554 |
| 5,178,184 | A | | 1/1993 | Skillman | 137/533.13 |
| 5,314,025 | A | | 5/1994 | Priestly | 166/369 |
| 5,450,897 | A | * | 9/1995 | Brown | 166/68 |
| 5,660,534 | A | * | 8/1997 | Snow | 417/554 |
| 5,743,336 | A | * | 4/1998 | Davis | 166/380 |

* cited by examiner

*Primary Examiner*—Charles G. Freay
*Assistant Examiner*—Timothy P. Solak
(74) *Attorney, Agent, or Firm*—Jenkens & Gilchrist, A Professional Corporation

(57) ABSTRACT

Fluid pumping apparatus for pumping fluids from a well comprising a downhole pump disposed near the lower end of a production string and including a tubular pump barrel and a tubular pump plunger concentrically disposed in the pump barrel in a sliding and sealing fit therewith, one of the pump barrel and the pump plunger being fixed to the production string, the other being attached to the lower end of a string of rods for reciprocal movement. A standing valve is provided in the fixed one of the pump barrel and the pump plunger. A traveling valve is provided in the other. A cylindrical polished rod, the lower end of which is connected to the string of rods, extends upwardly through a sealing assembly for sliding and sealing reciprocation therethrough, the diameter of the polished rod being at least as great as the outside diameter of the pump plunger. A power device is operatively connected to the polished rod for lifting and lowering the polished rod and the string of rods and lift the lower the nonfixed one of the pump barrel and the pump plunger between lower and upper terminal positions, pushing fluids upwardly through the production string on the downstroke of the pump.

21 Claims, 2 Drawing Sheets

DOWNSTROKE SUCKER ROD WELL PUMP

BACKGROUND OF THE INVENTION

1. Field of the Invention

The present invention pertains to pumping apparatus. More specifically, the present invention pretains to reciprocating pumps of the type used for producing fluids from subsurface wells.

2. Description of the Prior Art

Subsurface wells, particularly those for producing underground hydrocarbon fluids, typically include a string of tubing or "production string" which extends from near the bottom of the well to the surface for flow of fluids through a flow line connected to the production string at the surface. For wells which do not have enough pressure to produce fluids on their own, some type of pumping system must be employed.

Pumps for lifting subsurface fluids to the surface of an oil well have been in existence for many years. One type of pump, typically referred to as a lift pump, usually includes a tubular barrel (which may be a portion of the production tubing) and a cooperating plunger assembly which reciprocates therein. The plunger assembly may be attached to a rod or string of rods which extends to the surface of the well and by which the plunger assembly may be reciprocated by a source of power such as an internal combustion engine or an electrical motor. Examples of such pumps may be seen in U.S. Pat. Nos. 4,691,735 and 5,178,184.

A lift pump typically includes a standing valve which is fixed relative to the pump barrel and a traveling valve which is a component of the plunger assembly. The standing valve and traveling valve act as check valves, opening and closing, opposite each other, on upstrokes and downstrokes of the plunger assembly. For example, as the plunger assembly and the attached traveling valve are lowered on a downstroke, the standing valve is closed, blocking reverse fluid flow therethrough, and the traveling valve is opened, allowing fluid within the pump barrel to be displaced through the traveling valve into the production tubing thereabove. On the subsequent upstroke, the traveling valve closes, lifting the column of fluids thereabove towards the surface. Since pressure in the pump barrel below the traveling valve decreases during the upstroke, the standing valve then opens allowing fluid to flow into the pump barrel from the formation for a succeeding downstroke. As this process continues, fluid flows through the standing valve and into the pump barrel during the upstrokes and fluid above the traveling valve is lifted toward the surface of the well on the upstroke.

Since the fluids being produced from a well are typically located at some distance below the surface, in most cases hundreds of thousands of feet, a power unit associated with a lift pump must lift: i) a long string of steel rods, ii) the plunger assembly, and iii) a column of fluid the length of which is approximately equal to the depth of the well. This requires a great deal of energy. With lift pumps of the prior art, no fluid production occurs on the downstroke in which the plunger assembly and the string of rods is lowered before another upstroke. Thus the lifting of great weights on the upstroke requires a great amount of energy while the energy from the weight of the rods and plunger assembly on the downstroke is wasted and not utilized.

The great difference between the load on an upstroke and the lack of load on a downstroke creates a counterbalance problem on the power unit. This great difference in weight cannot be fully counterbalanced. If the power unit is powered by electricity (an electric motor), the electric motor draws much higher amperage on the upstroke than on a downstroke.

Another problem with lift pumps of the prior art is associated with stretching of the rods by which the plunger and fluids are lifted in the production string. The rods stretch on the upstroke and relax on the downstroke. This results in loss of movement or plunger travel as compared to the length of movement of the power unit stroke. This results in inefficiency.

Attempts have been made in the prior art to reduce the load and the energy required to lift fluids to the surface of a well. Specifically, attempts have been made to utilize the energy normally lost during the downstroke of the plunger assembly by pumping on the downstroke. One such attempt is described in U.S. Pat. No. 5,314,025. Although this pumping apparatus appears to utilize the weight of the rods in response to gravity as a source of pumping energy for pumping on the downstroke, it does not substantially reduce the energy required on the upstroke. This particular apparatus has other characteristics which have apparently prevented it from being accepted in the industry.

SUMMARY OF THE PRESENT INVENTION

The present invention comprises pumping apparatus for pumping fluids through the production string of a subsurface well. The apparatus, in a preferred embodiment, comprises a fixed tubular pump barrel attached to the lower end of the production string which has a standing valve in the lower end thereof to permit flow of fluids into the barrel but preventing flow of fluids out of the barrel. It also includes a reciprocating tubular pump plunger concentrically disposed in the pump barrel for sliding and sealing reciprocal movement therein. The reciprocating plunger is provided, on its bottom end, with a traveling valve which permits flow of fluids from the fixed barrel through the reciprocating plunger but prevents flow of fluids through the reciprocating plunger into the fixed pump barrel. The upper end of the reciprocating plunger projects out of the fixed barrel into the production string and is provided with flow passages at the upper end thereof through which fluid may flow from the barrel, through the plunger into the production string. The lower end of a string of rods is attached to the reciprocating pump plunger and extends upwardly through the production string to near the surface. A cylindrical polished rod is connected to the top of the string of rods and extends upwardly through the sealing means in the wellhead for sliding and sealing reciprocation therethrough. A power unit is operatively connected to the polished rod for lifting and lowering the polished rod and the string of rods to lift and lower the reciprocating pump plunger within the fixed pump barrel.

Unique features of the pumping apparatus of the present invention reside in the fact that the upper end of the reciprocating plunger projects out of the barrel and in the fact that the polished rod is of a diameter at least as great as the outside diameter of the pump plunger. For this reason, the volume of the polished rod displaced from the production string on the upstroke is at least as great as the volume of fluids displaced by the reciprocating plunger on the upstroke. Thus, no fluids are displaced or will flow through the production tubing into the flow line on the upstroke and the only energy required during the upstroke is energy required to lift: (a) the reciprocating pump plunger and (b) the string of rods attached thereto. However, as the string of rods and the reciprocating pump plunger are lowered on the downstroke, the energy derived from the weight of the string of rods and the pump plunger, due to the gravitational pull thereon, is utilized to force fluids in the fixed pump barrel through the reciprocating pump plunger and its traveling valve and through the production string to the surface for flow through the flow line connected to the production string. In summary, production is exactly the opposite of the typical lift pump in which fluids are produced on the downstroke; that is all production of fluids occur on the upstroke.

One of the major advantages of the pumping apparatus of the present invention is the utilization of the normally wasted energy associated with downward movement of the reciprocating pump plunger and the string of rods attached to the reciprocating pump plunger to force fluids to the surface of the well during the downstroke and the fact that the only energy required during the upstroke is energy required for lifting the string of rods and the reciprocating pump plunger. If the power unit is powered by an electrical motor, the motor draws essentially the same amperage on the upstroke as the downstroke, resulting in an approximately 50% reduction in electrical cost per barrel of produced fluid.

There is much less wear and tear, requiring less maintenance, yet the equipment is no more complicated and no more expensive than prior art lift pumps. Many other objects and advantages of the invention will be apparent from reading the description which follows in conjunction with the accompanying drawings.

DESCRIPTION OF PREFERRED EMBODIMENTS

Figure 1:
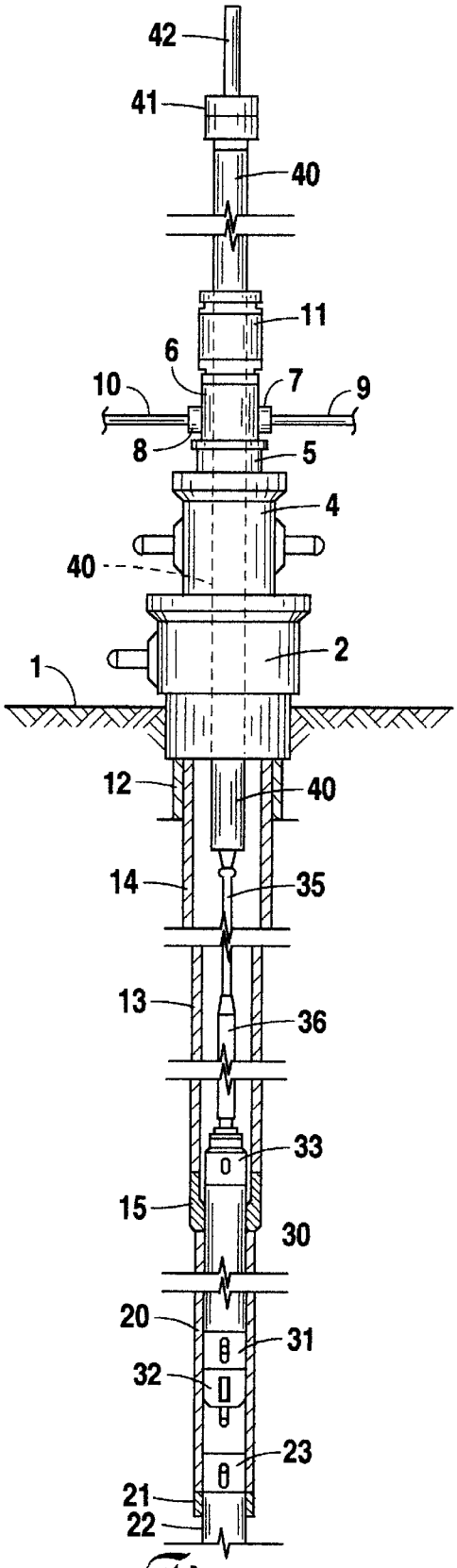
FIG. 1 is a vertical representation, partially in section, of a well and fluid pumping apparatus for pumping fluids from the well, according to a preferred embodiment of the invention.

Referring first to FIG. 1, there is shown a well, for example, an oil well for producing hydrocarbon fluids from a hydrocarbon bearing formation substantially below the surface of the earth. The surface is represented at 1. The well is provided at the surface 1 with a wellhead which includes a casing head 2 attached to the upper end of surface casing 3. Surmounted on the casing head 2 is a tubing head 4, a tubular spool 5 and a flow head 6. The flow head 6 may be provided with outlets 7 and 8. Outlet 7 is shown connected to a flow line 9. Outlet 8 may be connected to a bleeder line 10. Mounted on the top of the flow head 6 is a stuffing or packing box 11 for the polished rod 40 which is shown in more detail in FIG. 2 and will be more fully described hereafter with reference thereto.

As previously stated, the casing head 2 is supported on the upper end of the surface casing 3. The casing head 2 supports a production casing 12 and the tubing head 4 supports a tubing or production string 13 which extends substantially to the bottom of the well and through which fluids produced by the well may flow or be raised or pushed to the surface thereof. The first or upper joint 14 of the tubing or production string 13 is preferably oversized. Attached near the bottom of the production string 13 by a coupling 15 is a fixed tubular pump barrel 20 of a pump. Attached to the lower end of the fixed tubular pump barrel 20 by a coupling 21 may be a seating nipple, perforated nipple, bull plug or the like generally and collectively represented at 22. The nipple is perforated to allow collection of fluids in the lower end of the production string from the producing formation of the well. Attached to the lower end of the tubular barrel 20 is a standing valve 23 which, since it is fixed with the fixed barrel 20 in the well, is sometimes referred to as a standing valve.

Concentrically disposed in the tubular pump barrel 20 for sliding and sealing reciprocal movement therein is a reciprocating tubular pump plunger 30. Attached, in the exemplary embodiment, to the lower end of pump plunger 30 is a valve 31 which is sometimes referred to as a "traveling valve". Attached at the lower end of the reciprocating plunger 30 and under the standing valve might be a standing valve puller 32 the purpose of which would in some cases be to engage and remove the standing valve 23 when necessary. The upper end of the reciprocating plunger 30 is provided with flow passages through which fluid may flow from the interior of the plunger into the production string 13. These flow passages may be provided in a cage 33 or the like.

The upper end of the reciprocating plunger 30 is attached to a string of rods 35 sometimes referred to as "sucker rods". This connection may be made through a sucker rod coupler 36. The string of rods or sucker rods 35 extend to near the surface 1 where it is connected to a larger polished rod 40. The polished rod 40 extends through components of the wellhead and the stuffing box 11 for connection by a wire hanger 41 to a wire line 42. The wire line 42 is then operatively connected to a reciprocating power unit not shown) supplied with power through an internal combustion engine or electric motor (not shown) which lifts and lowers the wire line 42, in turn lifting and lowering the polished rod 40, the sucker rods 35 and the pump plunger 30 attached at the lower end thereof. These components and the operation thereof will be more fully described and understood hereafter.

Figure 2:
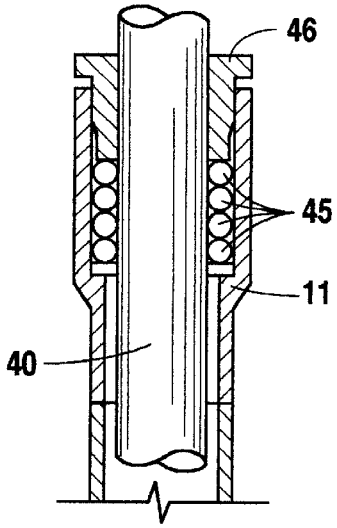
FIG. 2 is a detailed sectional view of an upper part of the fluid pumping apparatus of FIG. 1, according to a preferred embodiment thereof.

Referring now to FIG. 2, the stuffing box 11 and a portion of the polished rod 40 therein will be more fully described. The stuffing box 11 is provided with a counterbalanced area in which annular seals or packings 45 are mounted. A seal or packing gland 46 is threadedly connected to the upper end of stuffing box 11 to hold the sealing elements 45 in place. The polished rod 40 reciprocates within the stuffing box 11 in sliding and sealing engagement with the sealing elements 45. It is important that the diameter of the polished rod 40 be at least as great as the outside diameter of the pump plunger 30 connected to the string of rods therebelow. The reason for this will be more fully understood hereafter.

Figure 3:
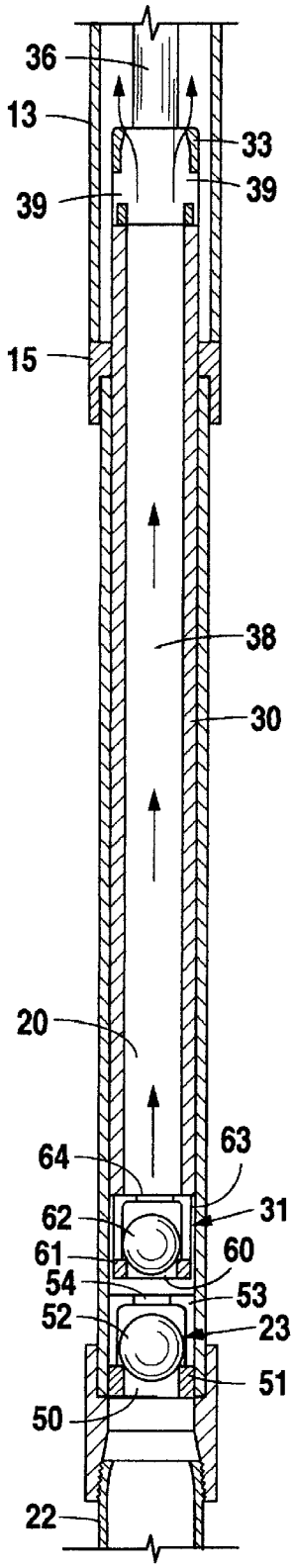
FIG. 3 is a longitudinal sectional view of a lower portion of the fluid pumping apparatus of the present invention, according to a preferred embodiment thereof.

Referring now to FIG. 3, the lower portion of the pumping apparatus of the present invention will be described in more detail. In FIG. 3, the standing valve puller 32 shown in FIG. 1 has been removed from under the standing valve since it is not necessary for operation of the pumping apparatus and would only be used for pulling the standing valve 23. FIG. 3 shows the tubular pump barrel 20 connected to the lower end of the production string 13 by the coupling 15. The perforated nipple 22 is connected to the lower end of the tubular pump barrel 20 by a coupling 21 and the standing valve 23 is attached to the lower end of the tubular barrel 20 in any suitable manner. It is preferably attached so that it can be engaged and removed by a standing valve puller such as the standing valve puller 32 of FIG. 1.

The standing valve 23 has a central flow passage 50 surrounded by a valve seat 51 which is engageable by a ball 52. The ball is enclosed in a cage 53 which allows limited upward movement of the ball 52 away from the seat 51. The cage 53 is provided with one or more flow passages 54 through which fluids may pass. The standing valve 23 acts as a check valve allowing flow of fluids from the perforated nipple 22 through the flow passages 50 and 54 into the interior of the tubular barrel 20. However, it prevents reverse flow therethrough, i.e., flow from the interior of the barrel 20 into the perforated nipple 22.

The outside diameter of the reciprocating tubular pump plunger 30 is slightly less than the inside diameter of the tubular barrel 20. However, the reciprocating pump plunger 30 is designed so that it may reciprocate within the pump barrel 20 in sliding and sealing engagement therewith. This may be in the form of a close fitting metal-to-metal seal, as illustrated in FIG. 3, or some type of sealing mechanism may be provided between the fixed barrel 20 and the reciprocating plunger 30. In any event, the plunger 30 is attached to the lower end of the rod string 35 by the sucker rod coupler 36 and, as already described with reference to FIG. 1, is caused to reciprocate with upstrokes and downstrokes in response to lifting and lowering of the polished rod 40, sucker rods 35 and pump plunger 30 by the power unit at the surface of the well.

As shown in the exemplary embodiment of FIG. 3, the traveling valve 31 is attached to the lower end of the reciprocating pump plunger 30. The traveling valve 31 is very similar to the standing valve 23. However, rather than being fixed as the standing valve 23 is with the pump barrel 20, the traveling valve 31 moves and reciprocates with the pump plunger 30. The traveling valve 31 may also be provided with a central passage 60 around which is provided a valve seat 61. A ball member 62 is carried within the cage 63 and the cage 63 is provided with flow passages such as flow passage 64. The traveling valve 31 also acts as a check valve allowing flow of fluids therethrough from the reciprocating tubular pump barrel 20 into the interior or central flow passage 38 of the pump plunger 30 but preventing reverse flow therethrough. The cage 33, attached to the upper end of the pump plunger 30, is provided with one or more flow passages 39 through which fluid may flow through the plunger interior 38 into the production string 13.

If desired, the traveling valve 31 could be installed near the upper part of the plunger 30. In fact, it could be placed where the cage 33 is shown. In such case, the cage 33 might even be eliminated. The pump barrel 20 and pump plunger 30 illustrated in FIGS. 1 and 3 comprise what is known in the industry as a "tubing pump" in that the barrel 20 is connected to the bottom of the tubing or production string 13. This pump could easily be adapted to an "insert pump" design in which the pump barrel and plunger are actually lowered into a production string and the barrel affixed thereto by a seating nipple of a cup type holddown or some other method.

There are at least two dimensions of the pumping apparatus of the present invention which are unique and critical. The length of the fixed or reciprocating plunger 30 must be the same or greater than the fixed or reciprocating pump barrel 20 so that the upper end of the pump plunger 30 extends out the top of the barrel 20 at all times. In addition, the outer diameter of the polished rod 40, as seen in FIG. 2, where it slidingly and sealingly engages the sealing elements 45 of the stuffing box 11, must be at least as great as the outside diameter of the pump plunger 30.

The operation of the pumping apparatus shown in FIGS. 1–3 will now be described. Initially, assuming that the plunger 30 is in the lower terminal position of FIG. 3, the string of rods 35 is lifted by the power unit causing the reciprocating pump plunger 30 to move upwardly (an upstroke) until the traveling valve 31 at the bottom of the plunger 31 is at the upper end of the pump barrel 20, the upper terminal position. As this occurs, the pressure within the space vacated by the reciprocating plunger within the fixed pump barrel is reduced and fluids flow from the production zone of the well through the perforated nipple 22 and the standing valve 23 into the pump barrel 20. On the subsequent downstroke, the string of rods 35 and the reciprocating plunger 30 move downwardly toward the lower terminal position illustrated in FIG. 3. As this occurs, fluid flows from the fixed pump barrel 20 through the traveling valve 31 into the inner passage 38 of the pump plunger 30 since the standing valve 23 will not permit reverse flow therethrough. This action continues until the production string 13 is filled to the surface and the flow outlet 7.

With the production string 13 maintaining a column of fluid therein, the pumping action continues. It is important to note at this point that as the string of rods 35 and the reciprocating plunger is lifted, the polished rod 40 is moving upwardly vacating a volume in the production string 14 at least as great as the volume now being occupied in the production string 13 by the pump plunger 30, remembering that the outside diameter of the polished rod is at least as great as the outside diameter of the reciprocating pump plunger 30. Thus, no fluids are being displaced or forced from the production string 13 on the upstroke. The only energy necessary during the upstroke is the energy expended in lifting the string of rods 35 and the pump plunger 30. However, as this occurs, fluids flow from the producing area of the well through the perforated nipple 22 and the standing valve 23 into the pump barrel 20.

On the subsequent downstroke, the plunger 30 descends into the pump barrel 20 and fluids therein are displaced through the traveling valve 31 and the inner flow passage 38 of the pump plunger 30 and through the cage 33 into the production string 13 and through the outlet 7 of flow head 6 into the flow line 9. The plunger 30 and the fluid within the passage 38 are, in effect, a piston whose diameter is equal to the outside diameter of the plunger 30. The volume of fluid displaced during the downstroke is equal to this cross-sectional area times the length of the downstroke.

It is important to note that the weight of the polished rod 40, the string of sucker rods 35, the plunger pump 30 and other components attached thereto is sufficient to displace the fluids within the pump barrel 20. Thus, the energy due to gravitational forces, normally wasted in the typical lift pump, is utilized to force fluids to the surface of the well. Furthermore, the only energy expended on the upstroke is energy required to lift the polished rod 40, the string of rods 35 and the pump plunger 30, and any fluid contained therein. No energy is expended on the upstroke to produce well fluids at the top of well. This substantially reduces the stretch that occurs in the sucker rods of lift pumps of prior art in which the power unit is required to lift not only the string of rods and the reciprocating plunger but a column of fluid. The stretching of the string of rods and then relaxing of the rods on the downstroke in prior art lift pumps reduces the pumping efficiency. Of course the major advantage of the pumping apparatus of the present invention is the substantial reduction in energy on the upstroke and the much easier balancing of the pumping apparatus with counterbalances. The pumping apparatus of the present invention can be designed so that the power unit, for example an electric motor, draws essentially the same amperage on the upstroke as it does on the downstroke.

Another feature of the pumping apparatus of the present invention resides in the fact that the upper end of the plunger always extends out of the barrel. With conventional lift pumps, the greatest wear on barrels and plungers is from sand and other solids getting between the barrel and plunger. Solids usually get into the barrel from above and are pulled between the plunger and the barrel as the plunger lifts in the barrel. With the present invention, solids are not allowed to settle out in the pump barrel. This should considerably extend the pump life.

Figure 4:
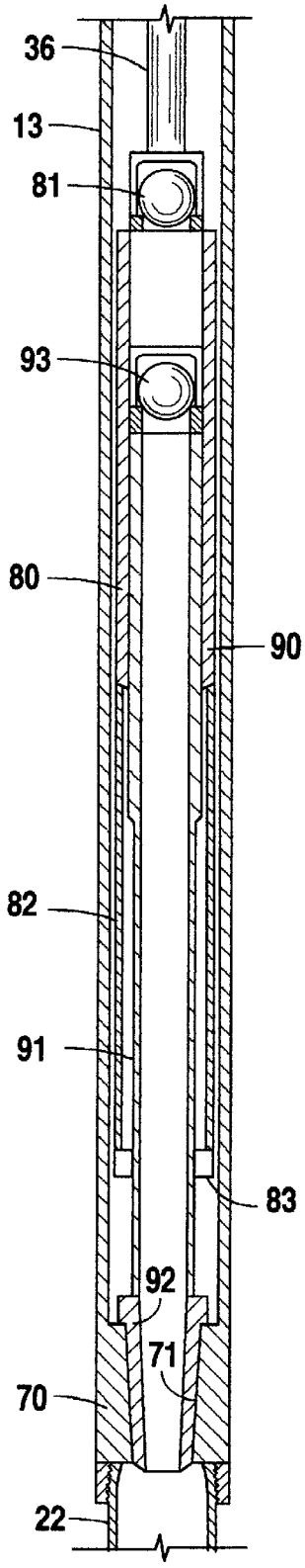
FIG. 4 is a longitudinal sectional view of a lower portion of the fluid pumping apparatus of the present invention, according to an alternate embodiment thereof.

The embodiment of the present invention just described with reference to FIGS. 1–3, in which the pump barrel 20 is stationary in the well and the pump plunger 30 is reciprocated therein, is a preferred embodiment of the invention. However, the principles of the invention can also be utilized in an alternate embodiment in which the plunger is stationary within the well and the barrel is reciprocated through downstrokes and upstrokes. The lower portion of such an embodiment is illustrated in FIG. 4. The sucker rod coupler 36 and all the elements of the pumping apparatus such as the string of rods 35, polished rod 40 and the wellhead components illustrated in FIG. 1 would be essentially the same.

In the alternate embodiment of FIG. 4, the production string 13 is modified to provide at the bottom thereof a coupling 70 which is provided on the interior thereof with threads 71 or any other type of suitable connection means for connecting a portion of the pumping unit as will be described hereafter. The perforated nipple 22 and other formation producing components would be connected below the coupling 70.

The alternate embodiment of FIG. 4 also comprises a tubular barrel 80 and a tubular plunger 90. However, in this embodiment, the barrel 80 is not stationary as in the previous embodiment but is attached to the lower end of the sucker rod coupler 36 for reciprocation therewith. The pump plunger 30 is not attached to the string of sucker rods, instead being attached by a smaller diameter tubular extension 91 and holddown component 92 to the production string coupling 70. As illustrated, the holddown component 92 comprises seating cups which seal in a seating nipple and may be pushed in to seat the pump and pulled out to unseat the pump. Of course, this connection could be made in any other suitable manner.

In the embodiment of FIG. 4, a traveling valve 81 is provided at the upper end of the tubular barrel 80 and is similar to the traveling valve 31 of the embodiment of FIGS. 1–3. The plunger 90 is provided with a standing valve 93 which is similar to the standing valve 23 of the embodiment of FIGS. 1–3.

As in the previously described embodiment, the barrel 80 and the plunger 90 telescopically engage each other in a sliding sealing fit. It will be noted that the barrel 80 is provided with a downwardly depending tubular jacket or extender 82 at the lower end of which is an annular collar or shoulder 83 which surrounds the tube extender 91 of the plunger 90. The jacket 82, collar 83 and the tube 91 serve only to restrict the length of the pump stroke and do not affect the hydraulics thereof.

It is important to note that the length of the plunger 90 is, as in the embodiment of FIG. 1–3, at least as great as the length of the barrel 80 so that the end of the plunger 90, the lower end in this case, always extends out of the barrel 80. Again, it is also important that the diameter of the polished rod 40 at the surface of the well be at least as great as the diameter of the plunger 90.

Operation of the embodiment of FIG. 4 is similar to the operation of the embodiment of FIG. 3. In explaining the operation of the embodiment of FIG. 4, it will be assumed that the production string 13 has been filled with previous strokes of the pumping apparatus. On the next upstroke, fluid will flow through the standing valve 93 filling the interior of the tubular barrel 80 with fluid. This fluid is prevented from flowing out of the barrel 80 into the production string 13 by the traveling valve 81 during the upstroke. As the tubular barrel 80 is filled with fluid, the same volume is being vacated by the polished rod 40 as it moves upwardly through the stuffing or packing box 11. Thus, no fluids are displaced and no fluids are produced through the flow line. The only energy required is energy required to lift the polished rod 40, the string of rods 36 and the tubular barrel 80, its jacket 82 and other connected components.

On the downstroke, the tubular barrel 80 moves downwardly, the standing valve 93 is closed and fluids are displaced through the traveling valve 81 into the production string 13 and out of the flow head outlet 7 into the flow line (see FIG. 1). The energy required for doing so is simply the energy derived from the gravitational pull on the polished rod 40, the string of rods 35 and the tubular pump barrel 80. The same objects and advantages accrue to the embodiment of FIG. 4 as in the embodiments of FIGS. 1–3, i.e., substantial power savings, substantial increase in pumping efficiency, much easier balancing, less wear and tear, etc.

Thus, the pumping apparatus of the present invention is unique in that fluids are pumped on the downstroke rather than on the upstroke as in lift pumps of the prior art. The major advantage of the pumping apparatus of the present invention is the utilization of the normally wasted energy on the downstroke of the pump and a substantial reduction of energy on the upstroke due to the fact that the only energy required is for lifting the string of rods and either the pump plunger or the pump barrel. There are a number of other advantages many of which have already been discussed. Another results from the fact that less tensile strength is required for the sucker rod. Accordingly, smaller rods of less weight may be used on the upper part of the rod string as long as sufficient weight is maintained to displace fluid at the depth of the well.

Two embodiments of the invention have been described in substantial detail. Other embodiments have been suggested. Still a number of other embodiments will be apparent to those skilled in the art. Accordingly, it is intended that the scope of the invention be limited only by the claims which follow.

What is claimed is:

1. A fluid pumping apparatus for conveying fluids to the earth's surface through a production string having a bottom near the producing formation and a top end connected to a flow line at the earth's surface, said apparatus comprising:

a downhole pump disposed near the lower end of said production string including a tubular pump barrel and a tubular pump plunger concentrically disposed in said tubular pump barrel in a sliding and sealing fit therewith, one of said tubular pump barrel and said tubular pump plunger being fixed to said production string, the other of said tubular pump barrel and said tubular pump plunger being attached to the lower end of a string of rods for reciprocal movement between lower and upper terminal positions;

said sliding and sealing fit between said tubular pump barrel and said tubular pump plunger constructed and arranged to provide a stationary seal at the bottom of the production string;

a standing valve provided in said fixed one of said tubular pump barrel and said tubular pump plunger which permits flow of fluids into said tubular pump barrel but prevents flow of fluids out of said tubular pump barrel;

a traveling valve provided in said other of said tubular pump barrel and said tubular pump plunger which permits flow of fluids from said tubular pump barrel into said production string;

a cylindrical polished rod, the lower end of which is connected to said string of rods, said cylindrical polished rod extending upwardly through sealing means located above the flow line for sliding and reciprocation therethrough, the diameter of said cylindrical polished rod being as great as the outside diameter of said tubular pump plunger; and power means operatively connected to said cylindrical polished rod for lifting and lowering said cylindrical polished rod and said string of rods to lift and lower said other of said tubular pump valve and said tubular pump plunger between said lower and upper terminal positions, whereby fluids are pushed through said production string into said flow line as said other of said tubular pump barrel and said tubular pump plunger is lowered from said upper to said lower terminal position and whereby no fluids are pushed through said production string to said flow line as said other of said tubular pump barrel and said tubular pump plunger is lifted from said lower to said upper terminal position.

2. The fluid pumping apparatus as set forth in claim 1 in which said traveling valve is closed when said other of said tubular pump barrel and said tubular pump plunger is lifted from said lower to said upper terminal position, no fluids flowing into the flow line, said standing valve being open to allow fluids to flow into said tubular pump barrel.

3. The fluid pumping apparatus as set forth in claim 1 in which said standing valve is closed when said other of said tubular pump barrel and said tubular pump plunger is lowered from said upper to said lower terminal position, said traveling valve being open to allow fluids to flow from said tubular pump barrel and through the production string for flow through the flow line.

4. The fluid pumping apparatus as set forth in claim 1 in which said traveling valve is attached to one end of said other of said tubular pump barrel and said tubular pump plunger.

5. The fluid pumping apparatus as set forth in claim 1 in which said standing valve is attached to one end of said fixed one of said tubular pump barrel and said tubular pump plunger.

6. The fluid pumping apparatus as set forth in claim 1 in which the length of said tubular pump plunger is as great as the length of said tubular pump barrel, assuring that end of said tubular pump plunger extends out of said tubular pump barrel at all times.

7. A fluid pumping apparatus for conveying fluids to the earth's surface through a production string having a bottom near the producing formation and a top end connected to a flow line at the earth's surface, said apparatus comprising:

a tubular pump barrel attached to the lower end of said production string and having a standing valve in said lower end thereof which permits flow of fluids into said tubular pump barrel but prevents flow of fluids out of said tubular pump barrel;

a tubular pump plunger concentrically disposed in said tubular pump barrel for sliding reciprocal movement any sealing fits therewith, said tubular pump plunger having a traveling valve therein which permits flow of fluids from said tubular pump barrel through said tubular pump plunger but prevents flow of fluid through said tubular pump plunger into said tubular pump barrel, the upper end of said tubular pump plunger projecting out of said tubular pump barrel into said production string and having at said upper end thereof flow passages through which fluid may flow from said tubular pump plunger into said production string;

said sealing fit between said tubular pump barrel and said tubular pump plunger constructed and arranged to provide a stationary seal at the bottom of the production string;

a string of rods, the lower end of which is attached to said tubular pump plunger, said string of rods extending upwardly through said production string to near said surface;

a cylindrical polished rod, the lower end of which is connected to said string of rods, said cylindrical polished rod extending upwardly through sealing means located above the flow line for sliding and sealing reciprocation therethrough, the diameter of said polished rod being as great as the outside diameter of said tubular pump plunger, and power means operatively connected to said polished rod for lifting and lowering said polished rod and said string of rods to lift and lower said tubular pump plunger within said tubular pump barrel, whereby fluids are pushed through the production string into the flow line as said tubular pump plunger is lowered into said tubular pump barrel and fluids are not pushed through the production string into the flow line as said tubular pump plunger is lifted out of said tubular pump barrel.

8. The fluid pumping apparatus as set forth in claim 7 in which said traveling valve is closed when said tubular pump plunger is lifted out of said tubular pump barrel, no fluids flowing into the flow line, said standing valve being open to allow fluids to flow into said tubular pump barrel.

9. The fluid pumping apparatus as set forth in claim 7 in which said standing valve is closed when said tubular pump plunger is lowered into said tubular pump barrel, said traveling valve being open to allow fluids to flow from said tubular pump barrel, and through the production string for flow through the flow line.

10. The fluid pumping apparatus as set forth in claim 7 in which said traveling valve is attached to the lower end of said tubular pump plunger.

11. The fluid pumping apparatus as set forth in claim 7 in which said traveling valve is attached to the upper end of said tubular pump plunger.

12. The fluid pumping apparatus as set forth in claim 11 in which said flow passages are provided through said traveling valve.

13. The fluid pumping apparatus as set forth in claim 7 in which the length of said tubular pump plunger is as great as the length of said tubular pump barrel, assuring that the upper end of said tubular pump plunger extends out of said tubular pump barrel at all times.

14. A fluid pumping apparatus for conveying fluids to the earth's surface through a production string having a bottom near the producing formation and a top end connected to a flow line at the earth's surface, said fluid pumping apparatus comprising:

a tubular pump barrel disposed within the production string for reciprocal movement therein between lower and upper terminal positions;

a tubular pump plunger concentrically disposed within said tubular pump barrel in a sliding and sealing fit therewith, said tubular pump plunger being fixed to said production string;

said sealing fit between said tubular pump barrel and said tubular pump plunger constructed and arranged to provide a stationary seal at the bottom of the production string;

a standing valve provided in said fixed tubular pump plunger which permits flow of fluids through said fixed tubular pump plunger into said tubular pump barrel but prevents flow of fluids out of said tubular pump barrel;

a traveling valve provided in said tubular pump barrel which permits flow of fluids from said tubular pump barrel into said production string but prevents reverse flow of fluids therethrough;

a string of rods, the lower end of which is attached to said tubular pump barrel, said string of rods extending upwardly through the production string to near the surface;

a cylindrical polished rod, the lower end of which is connected to said string of rods, said cylindrical polished rod extending upwardly through sealing means located above the flow line for sliding and sealing reciprocation therethrough, the diameter of said polished rod being as great as the outside diameter of said tubular pump plunger; and power means operatively connected to said polished rod for lifting and lowering said polished rod and said string of rods to lift and lower said tubular pump barrel between said lower and upper terminal positions, pushing fluids through said traveling valve and the production string as said tubular pump barrel is lowered from said upper to said lower terminal position and not pushing fluids through said traveling valve in the production string as said tubular pump valve is lifted from said lower to said upper terminal positions.

15. The fluid pumping apparatus as set forth in claim 14 in which said traveling valve is closed when said tubular pump barrel is lifted, no fluids flowing into the flow line, said standing valve being open to allow fluids to flow into said tubular pump barrel.

16. The fluid pumping apparatus as set forth in claim 14 in which said standing valve is closed when said tubular pump barrel is lowered, said traveling valve being open to allow fluids to flow from said tubular pump barrel and through the production string for flow through the flow line.

17. The fluid pumping apparatus as set forth in claim 14 in which said traveling valve is attached to one end of said tubular pump barrel.

18. The fluid pumping apparatus as set forth in claim 14 in which said standing valve is attached to one end of said tubular pump plunger.

19. The fluid pumping apparatus as set forth in claim 14 in which the length of said tubular pump plunger is as great as the length of said tubular pump barrel, assuring that one end of said tubular pump plunger extends out of said tubular pump barrel at all times.

20. The fluid pumping apparatus as set forth in claim 14 in which a plunger extension of smaller diameter is attached to the lower end of said fixed tubular pump plunger, said plunger extension being provided with means for fixing said tubular plunger extension and said tubular pump plunger to the production string.

21. The fluid pumping apparatus as set forth in claim 20 in which a tubular barrel extension of smaller inside diameter than the outside diameter of said fixed tubular pump plunger is attached to said lower end of said tubular pump barrel for reciprocal movement therewith, said lower end of said tubular barrel extension being provided with an inwardly projecting shoulder which limits reciprocal movement of said tubular pump barrel relative to said tubular pump plunger between said lower and upper terminal positions.

* * * * *

UNITED STATES PATENT AND TRADEMARK OFFICE

CERTIFICATE OF CORRECTION

PATENT NO. : 6,368,084 B1
DATED : April 9, 2002
INVENTOR(S) : Milton M. Skillman It is certified that error appears in the above-identified patent and that said Letters Patent is hereby corrected as shown below:

Column 3,
Line 9, delete the term "downstroke" and insert the term -- upstroke -- therein;
Line 10, delete the term "upstroke" and insert the term -- downstroke -- therein;

Column 10,
Line 6, delete the term "any" and insert the term -- and -- therein;
and,
delete the letter "s" from the term "fits".

Signed and Sealed this

Twenty-second Day of October, 2002

*Attest:*

*Attesting Officer*

JAMES E. ROGAN
*Director of the United States Patent and Trademark Office*